US006226936B1

(12) United States Patent
Grossman

(10) Patent No.: US 6,226,936 B1
(45) Date of Patent: May 8, 2001

(54) SHEET PILING-SUPPORTED MODULAR WALL SYSTEM

(75) Inventor: Jesse E. Grossman, Lyndonville, NY (US)

(73) Assignee: Glynn Geotechnical Engineering, Lockport, NY (US)

( * ) Notice: Subject to any disclaimer, the term of this patent is extended or adjusted under 35 U.S.C. 154(b) by 0 days.

(21) Appl. No.: 09/371,987

(22) Filed: Aug. 11, 1999

Related U.S. Application Data

(60) Provisional application No. 60/096,377, filed on Aug. 13, 1998.

(51) Int. Cl.[7] ..... E04B 1/98; E02D 5/02

(52) U.S. Cl. ..... 52/169.1; 405/272; 405/284; 248/351

(58) Field of Search ..... 52/604, 592.6, 52/169.1, 169.8, 745.09; 405/15, 272, 274, 276, 284, 285, 286; 248/351, 235, 250

(56) References Cited

U.S. PATENT DOCUMENTS 635,165 * 10/1899 Weyhe ..... 405/284
3,005,293 * 10/1961 Hunter ..... 52/604 X
3,420,065 * 1/1969 Holl ..... 405/284
4,490,075 * 12/1984 Risi et al. ..... 405/286 X
5,690,305 * 11/1997 Perkins ..... 52/169.1 X

* cited by examiner

*Primary Examiner*—James O. Hansen
(74) *Attorney, Agent, or Firm*—Jaeckle Fleischmann & Mugel, LLP

(57) ABSTRACT

The modular wall includes a sheet pile wall (12) with support brackets (20) that provide cantilever support to a facade of interlocking rows of blocks (30–34). The support member (20) includes vertical members that extend from the top of the sheet piling part way down the length of the sheet piling. Base members (24) extend from the vertical members and are supported by angled braces (22). Horizontally extending key members rest on the base members and are affixed thereto. The key members provide a key for connecting to a slot of a first row of modular blocks. The modular blocks are stabilized by geogrid (28) that is captured in the key and slot interconnection of the modular blocks and is affixed to the sheet piling or embedded in concrete fill (12).

10 Claims, 8 Drawing Sheets

SHEET PILING-SUPPORTED MODULAR WALL SYSTEM

This invention claims the benefit of the priority date of Provisional Patent Application No. 60/096,377, filed Aug. 13, 1997.

BACKGROUND OF THE INVENTION

This invention relates in general to sheet piling walls, and, in particular, to a sheet piling supported aesthetically pleasing modular wall system.

It is highly efficient and cost-effective to use vertical sheet piling in order to retain a bank of land, in particular a bank of land next to an excavation or adjacent a body of water. Sheet piling is also used in and around harbors and canals for establishing bulkheads against the water. Sheet piling may also be used in highway construction for stabilizing an embankment adjacent the highway. One drawback of sheet pile construction is its appearance that is unpleasant and otherwise unattractive. Sheet piling is made of steel and it usually rusts. Even if it is treated with a coating or painted, such treatment requires periodic and expensive maintenance.

Sheet piling walls have replaced older types of construction that included masonry walls with large stone and/or precast concrete blocks. Construction of such masonry walls is very expensive and time-consuming. In order to construct the wall, a temporary sheet pile wall is driven in order to retain the adjacent water or soil. Then the area behind the temporary sheet pile wall is excavated and the masonry wall is installed. The excavation behind the masonry wall is backfilled and the temporary sheet piling wall is removed. While such walls are attractive, they are often prohibitively expensive.

Today many harbors and other waterways including canals, such as the famous Erie Canal are being re-developed for commercial and recreational purposes. As such, there is a demand for construction techniques that will create more aesthetically pleasing environments for these reconstructed harbors and canals. As such, there has developed a long-felt and unfulfilled need for a cost-effective, aesthetically-pleasing wall.

SUMMARY

The invention solves the problem of the prior art and meets its unfelt need by providing a method of constructing an aesthetically-pleasing wall using sheet piling. The invention also provides a modular wall and a modular wall bracket that enables the construction of aesthetically-pleasing sheet pile walls.

The modular wall of the invention includes sheet piling that is driven into the ground along the location for the wall. The location may be adjacent a body of water, such as a harbor or a canal or adjacent a highway excavation. Sheet piling typically has an undulating pattern characterized by crests and troughs. This undulating pattern makes for a more durable design against the earth and water forces that act upon the sheet pile. The invention uses the troughs that face the excavation for supporting a support bracket that in turn supports a modular block facade. Support brackets are hung from the troughs of the sheet piling and extend down into the excavation and/or below the water line of the adjacent body of water. The support brackets provide a cantilever support for the facade. As such, the brackets include an elongated member that extends parallel to the sheet piling. Below the water or excavation line the support bracket has a base member that extends transverse to the support bracket and parallel to the length of the wall. The base member is in turn supported by a brace. The brace extends from the base member to the support bracket at a position between the base member and the top of the support bracket. In an alternate embodiment, the vertical member of the support bracket extends beyond the base member and the brace then extends from the base member down toward the lower portion of the vertical member.

DETAILED DESCRIPTION OF THE DRAWINGS

Figure 1:
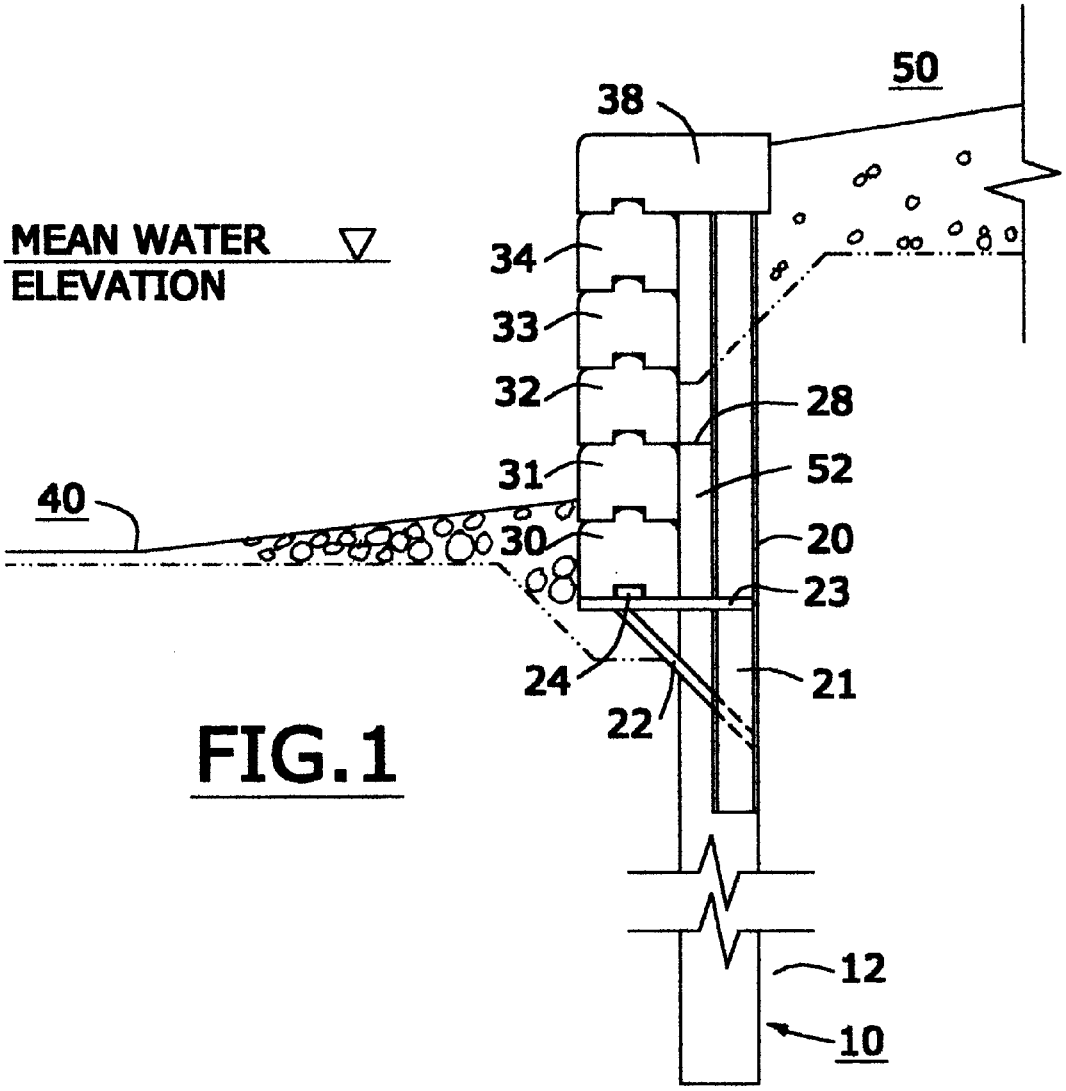
FIG. 1 is a side elevation view of the modular wall.

Turning to FIG. 1, there is shown a modular wall assembly 10. It includes sheet piling 12 that carries a support bracket 20 which in turn supports a facade comprising rows of pre-cast, interlocking concrete blocks 30–34 with a capping block 38. The invention is suitable for supporting walls adjacent bodies of water or for supporting walls adjacent any region where the subsoil has insufficient bearing capacity to support a masonry wall. The sheet piling 12 is driven into ground that is adjacent an excavation or a body of water 40. The blocks 31–34 are tied together by interlocking keys and slots. Between each row of blocks there is one or more sections of tying material 28 (geogrid). This is typically a mesh of polyethylene that covers the top of one block and is held in place when the superior block covers the key and slot interconnection of the lower block. The polyethylene mesh is affixed to the sheet piling or embedded in concrete fill.

In the embodiment of the invention shown in FIG. 1, the support bracket 20 includes a vertical member 21 that extends from the top of the sheet piling along the vertical face of the sheet piling to a point below the surface of the adjacent excavation or the bottom of the adjacent body of water 40. A base member 23 extends generally transversely from the vertical support member 21. The base member 23 supports a key element 24 that secures the slot in the lower block 30. The base member 23 is a cantilever support. In order to assist its supporting function, a brace 22 extends from the base member 23 to the vertical member 21. The brace extends below where the base member 23 is coupled to the vertical member 21.

Figure 2:
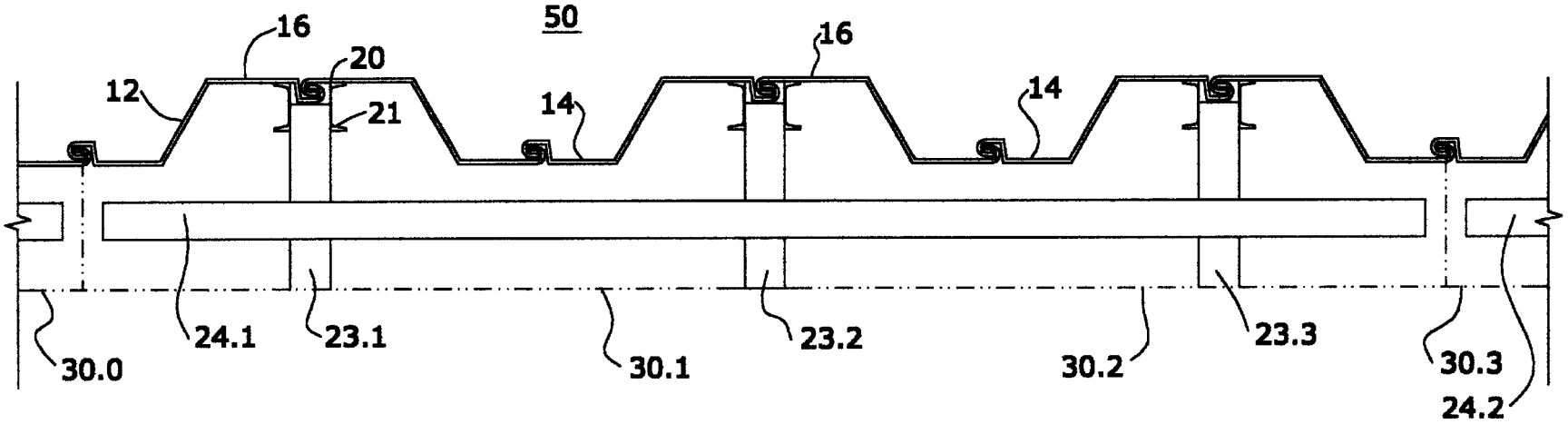
FIG. 2 is a plan view of a section of the modular wall.

Turning to FIG. 2, there it is seen that the sheet piling 12 forms a wall that faces the embankment 40 and presents a series of undulations including crests 14 and troughs 16. The support brackets 20 are located in the middle of the troughs 16 and the sheet piling. The key member 24 is a relatively narrow member that extends across three support brackets. In the preferred embodiment, the modular facade blocks 30 are sized so that two blocks are supported by three support brackets 20. The adjacent blocks 30.1 and 30.2 share a common support 21. The adjacent blocks 30.0 and 30.1, as well as 30.2 and 30.3 have a slight space between the sequential keys 24.1 and 24.2.

Figure 3:
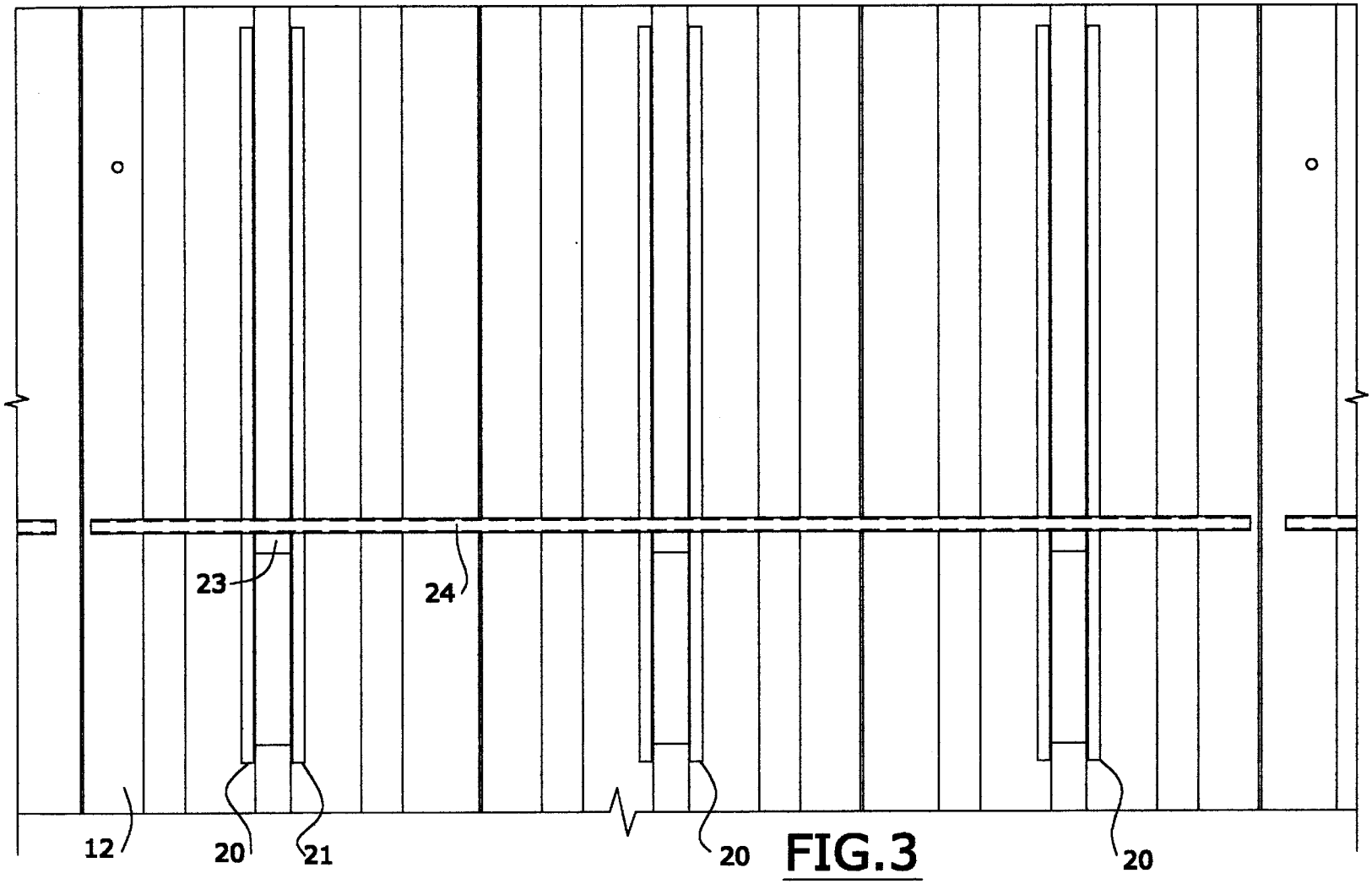
FIG. 3 is a front elevation view of a section of the wall corresponding to the planned view shown in FIG. 2.
Figure 4:
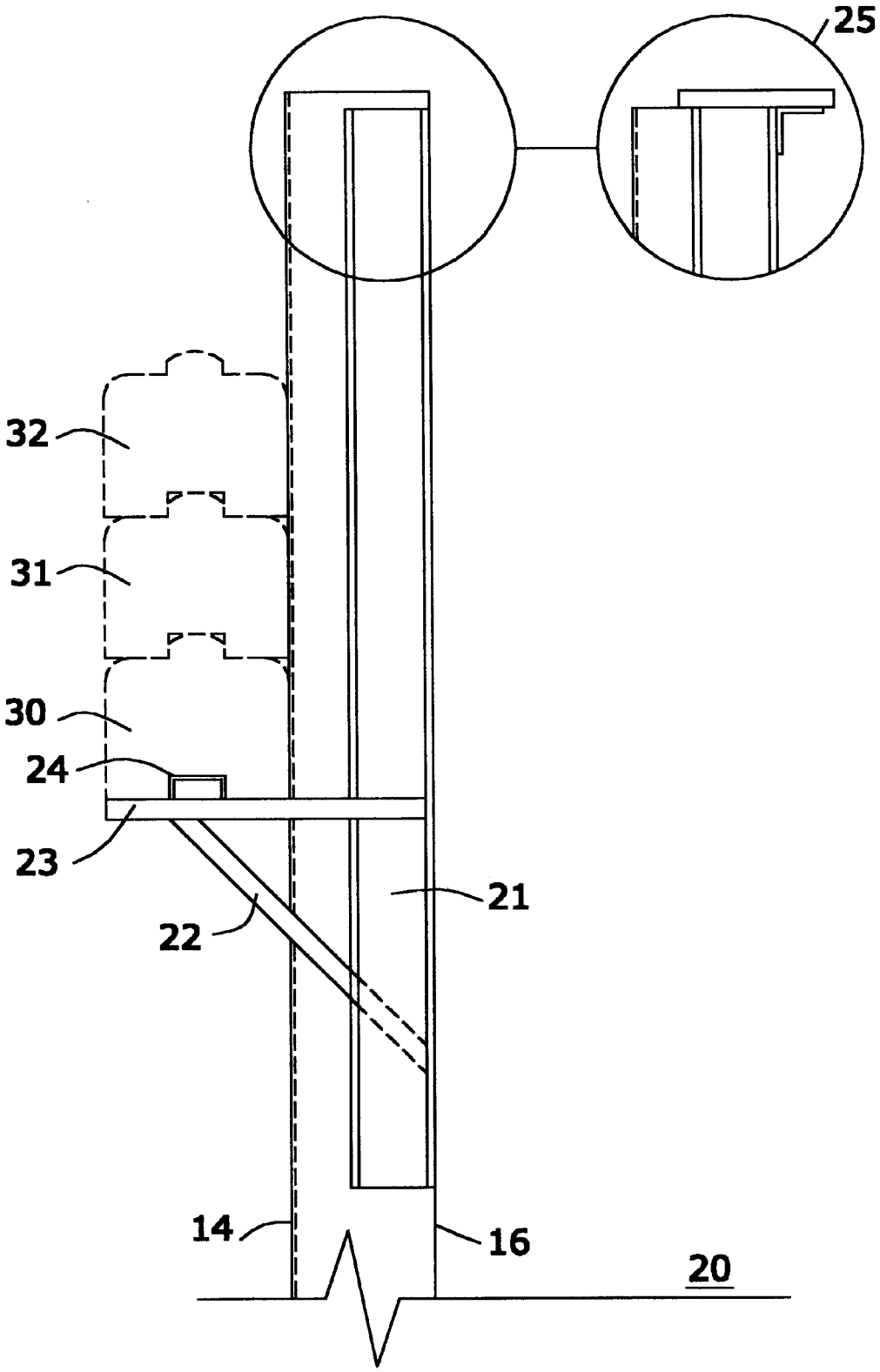
FIG. 4 is a detailed view of one embodiment of a support bracket for the modular wall.

Turning to FIG. 3, the series of brackets shown in FIG. 2 are presented in elevation form. The key support member 24 extends across the three support brackets. In FIG. 4, the support bracket 20 is shown in greater detail. The bracket is made of fabricated steel and is attached to the sheet piling by either hanging or welding. In an alternate embodiment of the invention a top hanger bracket 25 is mounted to one end of the vertical member 21. The base member 23 extends beyond the crest of the sheet pile 12 at lengths sufficient to accommodate the depth of the blocks 30–32. The blocks 30–32 have a key and slot interlocking arrangement and the lower block row 30 has its slot locked on the key 24 that extends over three of the base members 23.1, 23.2 and 23.3.

Figure 5:
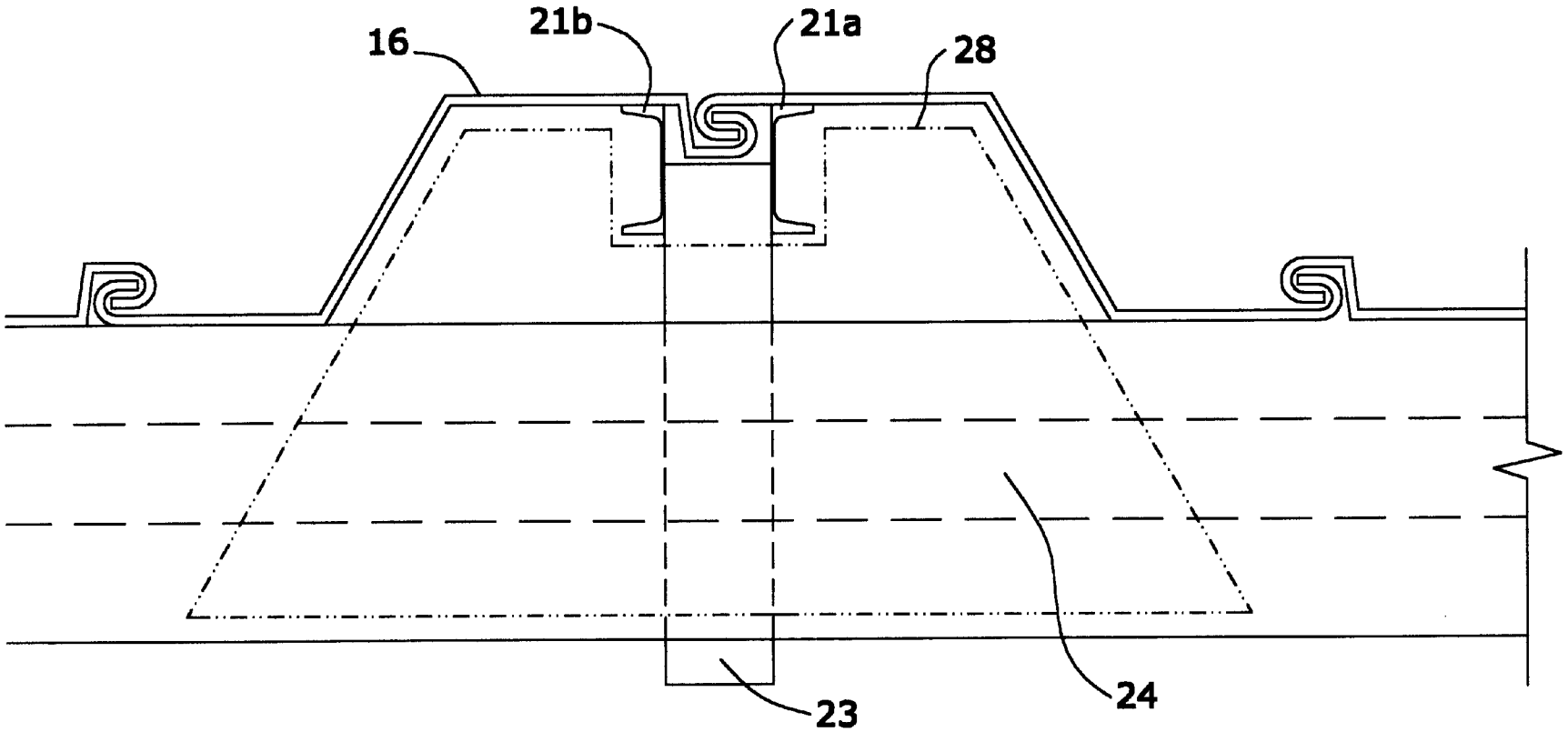
FIG. 5 is an expanded plan view showing how the support bracket of FIG. 4 is connected, trough of the sheet piling.

Further details of the support member 20 are shown in FIG. 5. There, the support bracket 20 has a left rail 21(*b*) and a right rail 21(*a*) that extend along an upper length of the sheet piling. The tying mesh 28 (geogrid) is shown extending over the key 24 that rests on the base member or over the subsequent superior keys of the modular rows of blocks 30–34. The space between the facade of the blocks 30–34 and the trough 16 may be filled with concrete 42.

Figure 6:
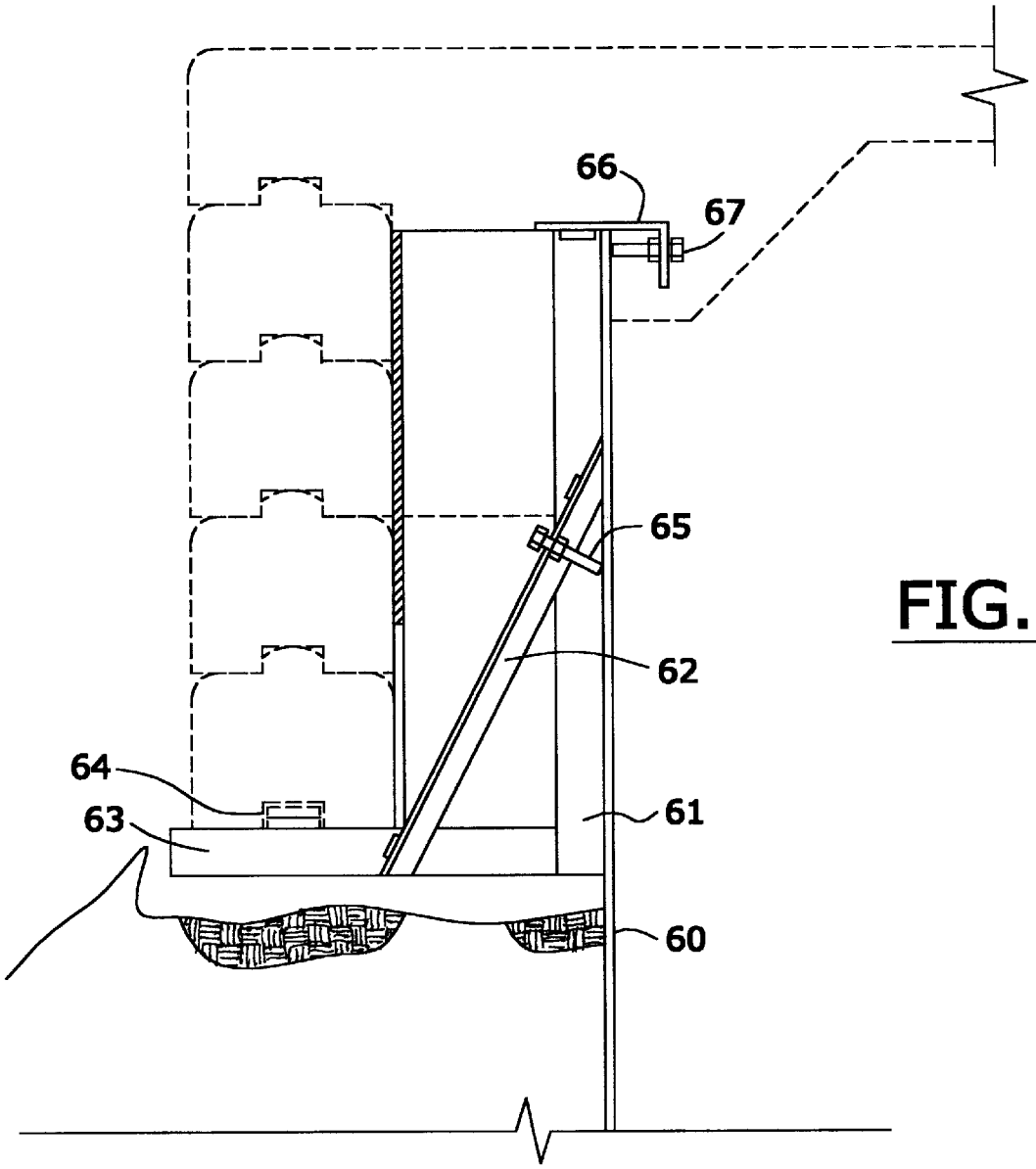
FIG 6. a side elevation view of an alternative embodiment of the invention.
Figure 7:
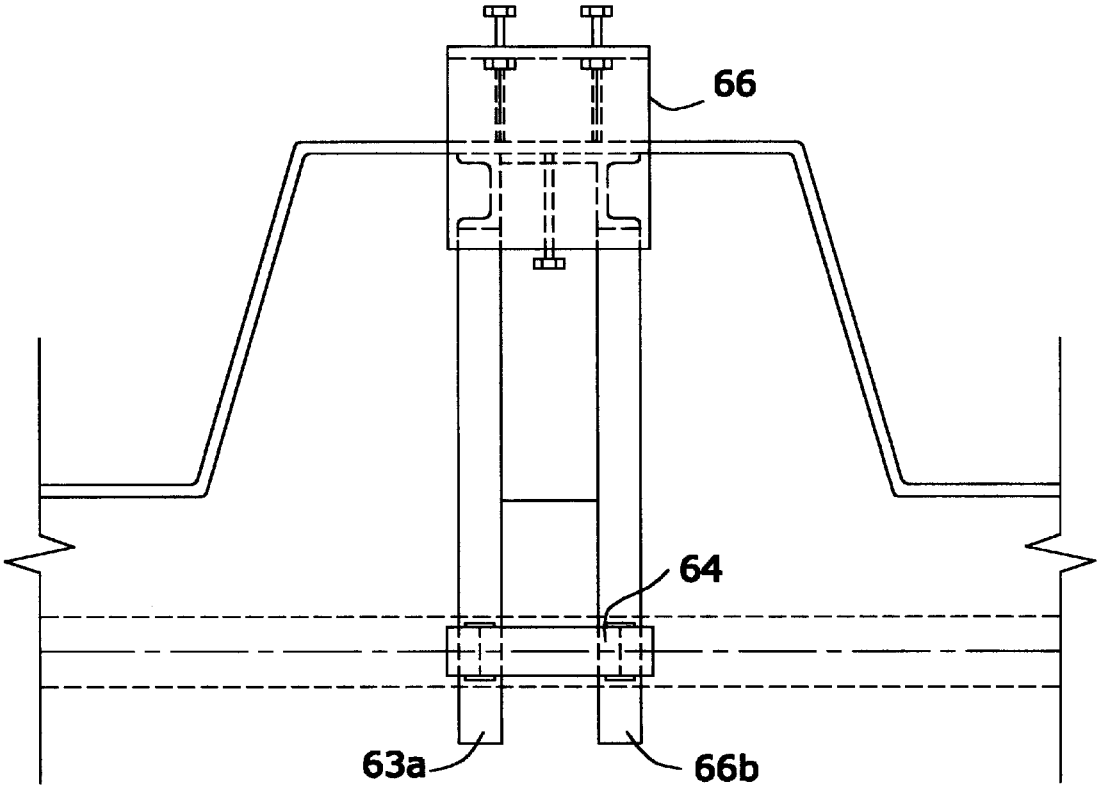
FIG. 7 is a sectional view showing how the embodiment of FIG. 6 is attached to the trough sheet piling.
Figure 8:
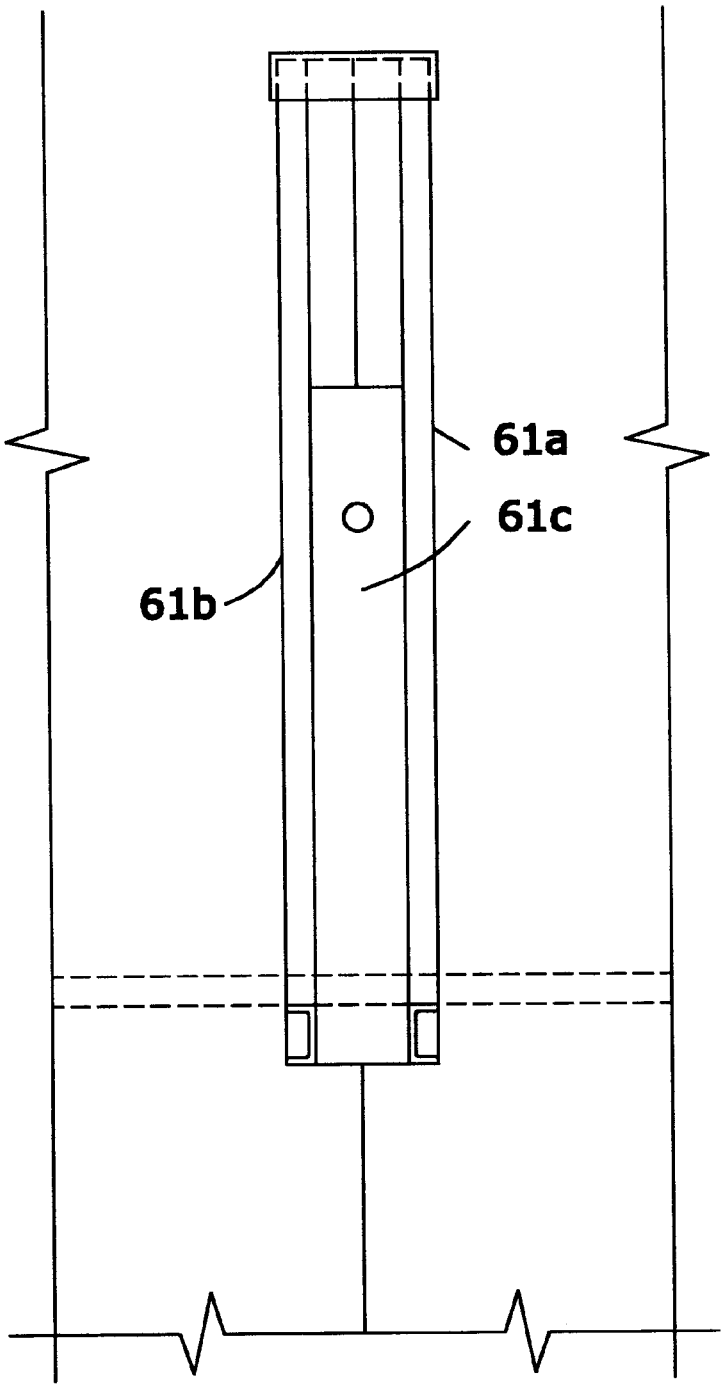
FIG. 8 is a front elevation view of the support bracket of FIG. 6.

An alternate embodiment of the invention is shown in FIGS. 6–8. Here the cantilever support 60 has a brace member 61 that extends upwardly from the base 63 to the vertical support member 61. The base member 63 also supports an elongated key member 64. The top of the support member 60 has an L-shaped coupling bracket 66 that fits over the top of the sheet piling. A nut and bolt assembly 67 couple the top brackets 66 to the sheet piling (not shown). Another nut and bolt assembly 65 connects one end of the brace 62 to the vertical support member 61. As shown in more detail in FIG. 67, the vertical support member 61 comprises left and right hand members 61(*a*), 61(*b*) that are coupled together by a central member 61(*c*). Similar details are shown in FIG. 8.

In operation, sheet piling is driven into ground adjacent an excavation or an area to be excavated or adjacent a body of water, such as a river, lake, canal or harbor. Support brackets 20 or 60 are coupled from the top of the sheet piling down along the partial length of the sheet piling. The brackets 20, 60 extend long enough to be covered by the backfill of the excavation or by the adjacent body of water. Each bracket includes a vertical member, a base member, and a diagonal brace. Thus, the bracket provides cantilever support for modular blocks that are assembled on a key member that extends between two or more of the base members on adjoining brackets. Modular blocks with slots are placed over the key members in sequential horizontal and vertical order. In between rows of blocks, stabilizing tying material such as geogrid 28 extends between a key and slot and is coupled at one end to the sheet piling or embedded in concrete fill. The geogrid stabilizes the block facade 30–36 so that it resists any torque that would separate the facade from the piling. Upon completion, the excavation may be backfilled to cover the bottom of the facade. Thereafter, the resulting modular wall presents an aesthetically pleasing appearance of a masonry wall together with the strength and convenience of assembly provided by sheet piling

Having thus described the two embodiments of the invention, those skilled in the art will appreciate that further changes, modifications, additions and omissions may be made to the disclosed embodiments without departing from the spirit and scope of the invention.

What is claimed is:

1. A modular wall comprising:

sheet piling driven into ground to form a wall of sheet piling;

support brackets coupled to the sheet piling and extending along the length of the sheet piling and from one face of the sheet piling for supporting a facade;

a key extending along said support bracket's length for fitting into a locking slot of a modular facade block;

one or more rows of blocks of facade supported by the support brackets and covering the face of the sheet piling.

2. The modular wall of claim 1 wherein the support bracket is a cantilever support bracket and comprises a base member with an inner edge extending from the sheet piling and a angled support bracket extending at an angle from the base member to the sheet piling for supporting the base member by transferring a vertical load on the base member to the sheet piling.

3. The modular wall support of claim 2 wherein the base member has a key extending along it length for fitting into a locking slot of a modular facade block.

4. The modular wall of claim 2 wherein the angled bracket extends toward the top of the sheet piling and above the base member.

5. The modular wall of claim 2 wherein the angled bracket extends toward the bottom of the sheet piling and below the base member.

6. The modular wall of claim 1 wherein the support brackets comprise an elongated vertical member coupled at first end to the top of the sheet piling extending vertically along the sheet piling and coupled to a base member extending from the support bracket and away from the bracket and the sheet piling, and a brace member extending from the base member to the vertical member.

7. The modular wall of claim 1 wherein the support brackets comprise an elongated vertical member extending vertically along the sheet piling and coupled at a first end to the top of the sheet piling, a base member extending from the support bracket at a location between its two ends and extending and away from the vertical member and the sheet piling, and a brace member extending from the base member toward the vertical member and coupled to the vertical member.

8. The modular wall of claim 1 further comprising means for tying the rows of blocks to the sheet piling.

9. The modular wall of claim 8 wherein the means for tying the rows of blocks to the sheet piling comprises a grid of flexible plastic.

10. The modular wall of claim 1 wherein the sheet piling comprises a series of undulating sheets with crests and troughs and the support brackets are located in the troughs.

* * * * *